US007850090B2

(12) United States Patent
Ollendick

(10) Patent No.: US 7,850,090 B2
(45) Date of Patent: Dec. 14, 2010

(54) SPIKELESS TIE PLATE FASTENERS, PRE-PLATED RAILROAD TIES AND RELATED ASSEMBLIES AND METHODS

(76) Inventor: David Ollendick, 2712 Industrial Dr., Ogden, UT (US) 84401

( * ) Notice: Subject to any disclaimer, the term of this patent is extended or adjusted under 35 U.S.C. 154(b) by 415 days.

(21) Appl. No.: 12/004,891

(22) Filed: Dec. 21, 2007

(65) Prior Publication Data

US 2008/0121731 A1 May 29, 2008

Related U.S. Application Data

(63) Continuation-in-part of application No. 11/231,140, filed on Sep. 19, 2005, now abandoned, which is a continuation-in-part of application No. 11/089,164, filed on Mar. 24, 2005, now abandoned.

(51) Int. Cl.
*E01B 9/14* (2006.01)

(52) U.S. Cl. ..... 238/29

(58) Field of Classification Search ..... 238/29–31, 238/34–39; 52/127.1, 514, 514.5
See application file for complete search history.

(56) References Cited

U.S. PATENT DOCUMENTS 1,169,158 A * 1/1916 Houghton ..... 238/35
5,553,777 A * 9/1996 Lampe ..... 238/35

* cited by examiner

*Primary Examiner*—S. Joseph Morano
*Assistant Examiner*—Robert J McCarry, Jr.
(74) *Attorney, Agent, or Firm*—Lynn G. Foster

(57) ABSTRACT

Railroad tie plates secured collectively by spikeless fasteners to a tie with railroad spikes securing the rails to the ties and related methodology are disclosed wherein two-part fasteners are used in respect to sets of aligned tie and tie plate apertures such that the two fastener parts are joined together against inadvertent separation within each tie aperture at a connection or union site, which includes but is not limited to force fit unions and threaded unions, and spikes are driven into the ties through other tie plate apertures. Discarded ties rehabilitated as composite railroad ties are also disclosed.

5 Claims, 7 Drawing Sheets

SPIKELESS TIE PLATE FASTENERS, PRE-PLATED RAILROAD TIES AND RELATED ASSEMBLIES AND METHODS

This application is a continuation-in-part of my U.S. patent application Ser. No. 11/231,140, filed Sep. 19, 2005, now abandoned which is a continuation-in-part of U.S. patent application Ser. No. 11/089,164, filed Mar. 24, 2005 now abandoned.

FIELD OF INVENTION

The present invention relates generally to tie-supported railroad tracks and more particularly to spikeless tie plate fasteners, pre-plated railroad ties having at least one spikeless tie plate fastener and at least one spike fastener through each tie plate, related assemblies and methods.

BACKGROUND

In regard to railroad ties formed of wooden, plastic and composite materials, traditionally only spikes are driven through apertures in two-spaced tie plates, each placed on top of each tie, into non-apertured tie locations. The extent to which the spikes, once driven, and the tie plates through which the spikes pass are held in place depends on the compression forces of the tie material against each spike. If the spikes loosen, the associated tie plate will also loosen, creating a potential for damage and a danger for trains traveling over the track. While the driven-spike-only approach typically works well with soft wood and other soft materials, it often does not with hard woods and other hard materials. While hard wood ties last longer than soft wood ties, hard wood ties are too often split by the spikes as the spikes are driven. Thus, the split hard wood tie does not compressively hold the spikes in the fully driven position and the tie plates become loose creating the potential for damage and danger as mentioned above.

Use of nut and bolt fasteners in lieu of and/or together with spikes for hard wood ties has heretofore been rejected in the railroad industry because of the cost of pre-drilling the ties and the nut and bolt fasteners, and difficulty in stacking such pre-plated ties in inventory and on transportation vehicles. Tightening of such bolts into associated nuts, to retain an associated tie plate tightly on the tie, has been problematic because the nut not only extends below the bottom of the tie, but often rotates as the bolt is rotated.

Screw spikes, which tend to cause the tie to split, have also been proposed for holding tie plates correctly on top of railroad ties, but the screw spikes tend to fracture, under the forces of train vibration over time, at the reduced diameter site located between the shank and the top of the threads.

Based on the prior art described above, it would be a major break through to provide effective spikeless tie plate fasteners, reliable pre-plated railroad ties having at least one spikeless tie plate fastener and at least one spike fastener in each tie plate, and related assemblies and methods.

BRIEF SUMMARY AND OBJECTS OF THE INVENTION

In brief summary, the present invention overcomes or substantially alleviates problems of the past related to securing tie plates to railroad ties, especially, but not limited to, dense ties comprised, for example, of hard woods and other dense materials. More specifically, the present invention is directed to novel spikeless tie plate fasteners, pre-plated railroad ties having at least one spikeless tie plate fastener and at least one spike fastener in each tie plate, railroad tracks comprising such and related assemblies and methodology.

Railroad ties, including those formed of hard wood, synthetic resin or composite material, formed as one or more pieces, are apertured top to bottom with an at least one aperture matching the location of an aperture in each of two tie plates. With one tie aperture aligned with one tie plate aperture in both tie plates, the two-parts of the fastener are oppositely inserted into each pair of aligned apertures. The two fastener parts in both aligned pairs of apertures are joined together against inadvertent separation within the associated tie aperture at a connection or union site, between the two fastener parts, which includes but is not limited to force-fit unions and threaded unions. When spikes are used to secure the rails, at least one spike is driven through at least one other aperture in each tie plate into undrilled tie material. Thus, each such tie plate is secured by one or more of the above-mentioned nut and bolt fasteners and by one or more driven spikes.

Typically, each two-part fastener comprises a first or top shaft fastener member inserted through aligned tie plate and tie apertures so that a proximal head thereof is contiguous with the top surface of the associate tie plate. A distal end portion of the first fastener member is disposed within the associated tie aperture and is not connected to the tie. The distal end portion, in the assembled state, is disposed above the bottom surface of the tie in the associated tie aperture. The other, lower or bottom fastener member is inserted from the bottom of the tie into the associate tie aperture, in non-rotatable relation. The other fastener member is preferably entirely disposed within the associate tie aperture (to better allow stacking of pre-plated railroad ties in inventory and on transportation vehicles) and may be covered by a layer or seal for the purpose of protecting the other fastener member from corrosion infiltrating from the ballast. The two-part fastener prevents or alleviates layer separation and shifting when used with multi-layered ties.

The present invention also relates to rehabilitation of used, discarded and damaged wooden railroad ties by creating and removing the damaged portion and replacing it by a like undamaged portion using male/female elements between the salvaged and new portions.

With the foregoing in mind, it is a primary object of the present invention to overcome or substantially alleviate problems of the past related to securing tie plates to railroad ties.

Another paramount object is the provision of a novel system, unique assemblies and distinct methodology for building railroads, pre-plating railroad ties comprising at least one spikeless fastener and at least one driven spike, the spikeless fastener comprising two-parts for use in pre-formed apertures of railroad ties to assist in securing tie plates in position, which features are especially effective with ties formed of hard dense material, such as hard woods, high molecular weight plastics and dense composites.

Another important object is the provision of novel spikeless tie plate fasteners, pre-plated railroad ties using both spikeless fasteners and spikes to secure tie plates to the ties, railroad tracks comprised of such, and related assemblies and methodology.

Another significant object is to provide novel combinations comprised of a multi-layered railroad tie, tie plates and two-part spikeless fasteners, which prevent or alleviate layer separation and layer shifting.

An additional paramount object of this invention is to rehabilitate used, damaged and discarded wooden railroad ties.

A further object of value is the rehabilitation of damaged railroad ties by removing the damaged portion and integrally replacing it with a like undamaged portion.

Another important object is to integrally combine at least two partial railroad ties into a single railroad tie using male/female connections therebetween.

These and other objects and features of the present invention will be apparent from the following detailed description taken with reference to the accompanying drawings.

DETAILED DESCRIPTION OF THE ILLUSTRATED EMBODIMENTS

Reference is now made to the drawings wherein like numerals are used to designate like parts throughout. As mentioned above, when hard wood ties are used to build or renovate a railroad track, the traditional method of utilizing railroad spikes is often counterproductive because the spikes tend to split the hard wood so that the embedded end of the spikes are not held tightly in position and, therefore, loosen responsive to railroad vibrations as trains move along the track. This can and does create certain risks of damage and danger and increases the amount of maintenance attention required. The same difficulty tends to exist when other dense materials are used, such as high molecular weight synthetic resinous materials and dense composite materials. While the present invention is directed toward railroad ties made of dense material, the present invention works well with softer tie materials, such as soft woods.

Central to the present invention is to utilize preformed apertures in railroad ties into which novel two-part fasteners are placed. One such two-part fastener is illustrated in FIG. 1, to which reference is now made.

Figure 1:
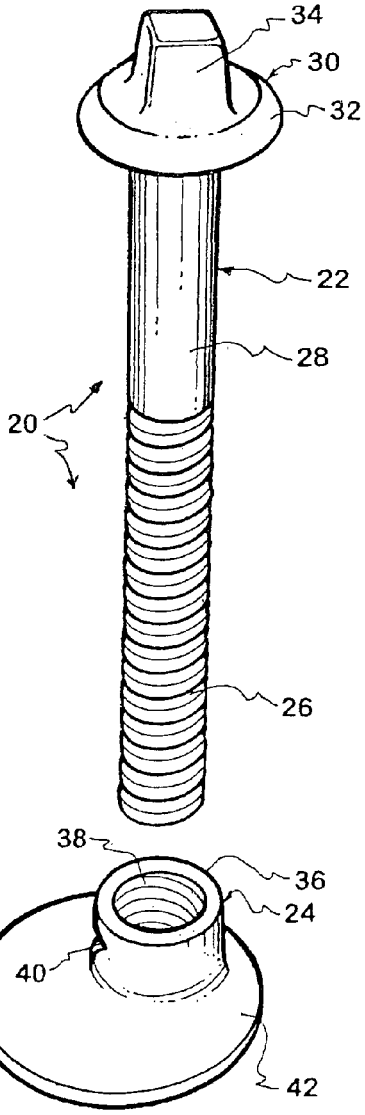
FIG. 1 is an exploded perspective of a two-part fastener in accordance with principles of the present invention.

The two-part fastener of FIG. 1 is generally designated 20 and comprises first and second fastener members, generally designated 22 and 24, respectively. The two-part fastener 20 is adapted to be used in lieu of a railroad spike to resolve or alleviate the tie splitting problem mentioned above. The first or top fastener member 22 comprises a male or shaft fastener member comprising distal threads 26, a smooth shank 28 above the threads 26 and a proximal head, generally designated 30.

The head 30 comprises a diametrally enlarged flange 32, the diameter of which is substantially greater than the diameter of the shaft comprising shank 28 and threads 26 and substantially greater in diameter than the apertures preformed in the railroad ties, as explained hereinafter in greater detail. The head 30 also comprises an upwardly extending square-shaped four-sided projection by which the fastener member 22 is rotated using a conventional wrench or the like. The head 30 is adapted to be exposed above a tie plate after the plate is placed on the top of a railroad tie, so that the enlarged annulus or flange 32 rests contiguously and forcibly upon the top surface of the associated tie plate, as explained herein in greater detail.

While any one of several materials may be utilized to form fastener member 22, currently for cost and reliability purposes, a high grade steel is preferred.

Figure 4:
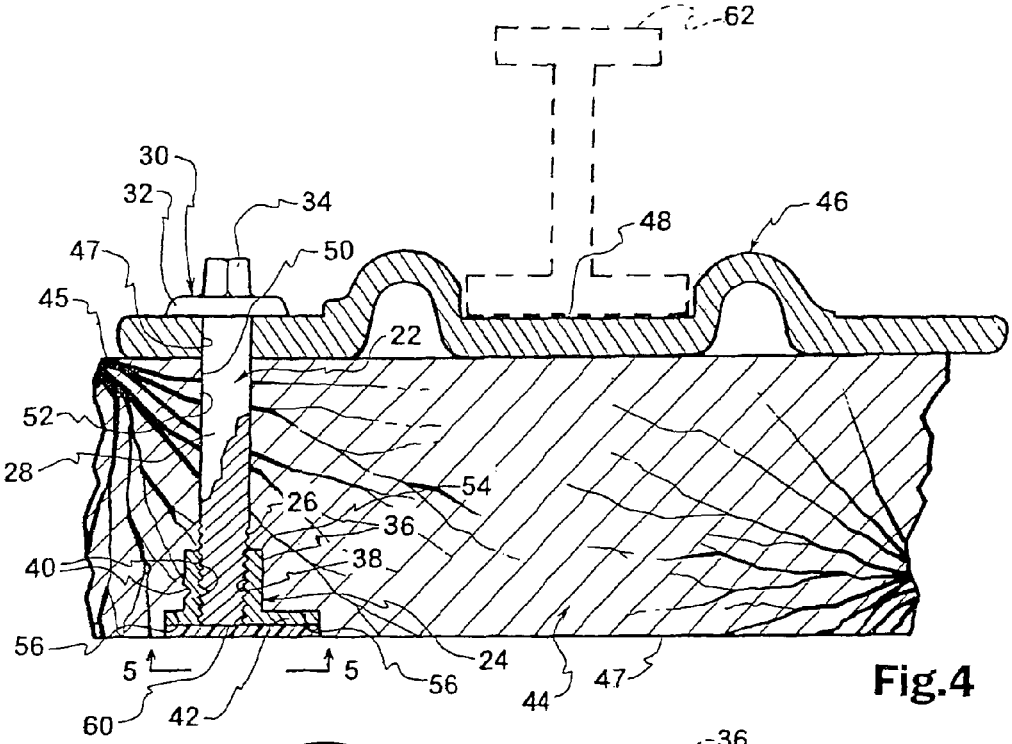
FIG. 4 is an enlarged fragmentary cross-section taken along lines 4-4 of FIG. 3.

With continued reference to FIG. 1, the second fastener member 24 comprises a boss 36 comprising a hollow interior defined by internal threads 38. The boss 36 is illustrated as being crimped or indented at site 40, which reduces the diameter of the internal threads 38 in a localized region. The boss 36 is formed as one piece or integrated with an anti-rotate eccentric base 42, illustrated as being planar or plate-like. When the second fastener member 24 is placed in a stepped aperture from the bottom of a railroad tie, as illustrated in FIG. 4, the eccentric relationship between the center line of the boss 36 and the center line of the base 42, when positioned as illustrated in FIG. 4, prevents the fastener member 24 from rotating as the fastener member 22 is turned causing matching or mating threads 26 and 38 to become threadedly connected, with the crimp 40 preventing inadvertent reverse rotation of threads 26 in respect to threads 38. Thus, the insertion and, if necessary, removal of fastener 20 can be accomplished from above the tie.

Figure 2:
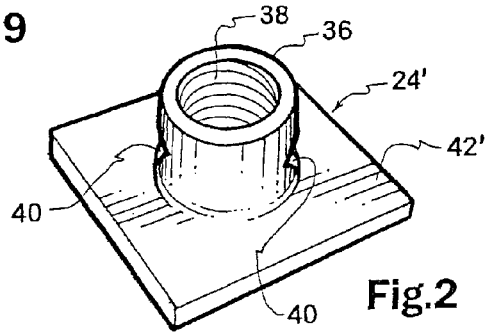
FIG. 2 is a perspective of a second lower fastener member, which may be substituted for the lower fastener member FIG. 1.
Figure 7:
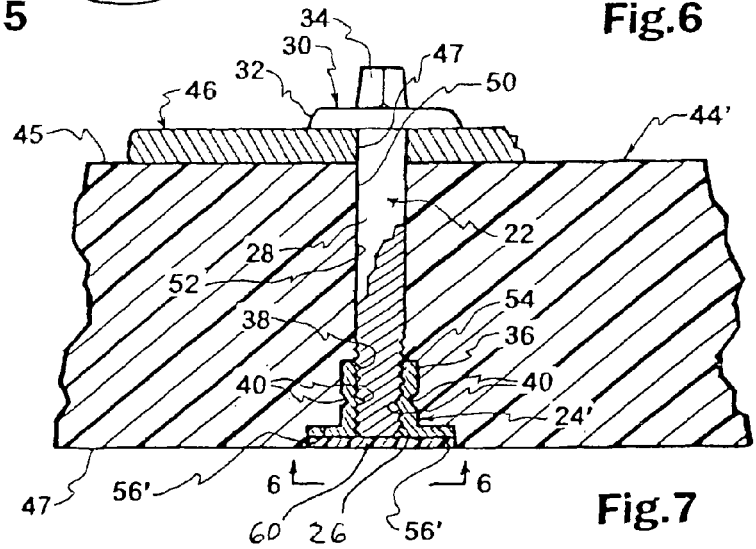
FIG. 7 is an enlarged fragmentary cross-section, similar to FIG. 4, illustrating the railroad tie of plastic or composite material as opposed to hard wood.

Reference is now made to FIG. 2, which illustrates a second form of a lower fastener member, generally designated 24', comprising the previously described boss 36, equipped with two opposed crimps or indentations 40 to prevent inadvertent reverse rotation or the top fastener member, as explained above. The boss 36 of FIG. 2 is formed as one piece or as integrated with a rectangular or square base 42', which is flat or planar in its configuration and, when placed in a rectangular recess at the lower part of a vertical aperture in a railroad tie, as shown in FIG. 7, becomes an anti-rotate component preventing boss 24' from turning as fastener 22 is threaded into threads 38 of the lower fastener member 24'.

Figure 3:
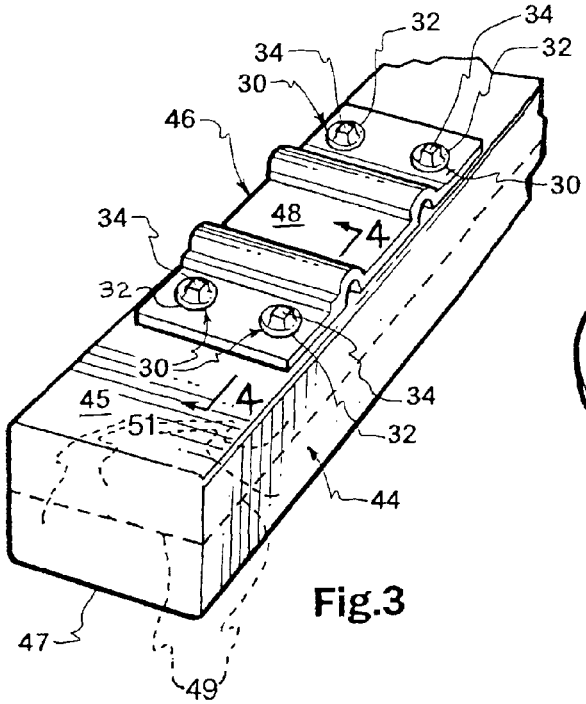
FIG. 3 is a fragmentary perspective of a railroad tie having a tie plate mounted at the top surface thereof, using the two-part fasteners illustrated in FIG. 1.

When the two-part fastener of FIG. 1 or a two-part fastener comprising fastener member 22 FIG. 1 and fastener member 24' of FIG. 2 are properly assembled with a tie plate and a pre-apertured railroad tie, the configuration illustrated in FIG. 3 results. In FIG. 3, the railroad, either monolithic or layered, tie is generally designated 44 and comprises a top surface 45 and a bottom surface 47. The dotted line 49 denotes the interface between two or more layers 51 when a multi-layer tie is used. The layers may simply be aligned and contiguous at interface 49, or part or all of the interface 49 may receive a suitable bonding agent to adhere the layers together. The tie plate, which is conventional, is generally designated 46. Tie plate 46 comprises a central flat region 48 upon which a railroad rail is placed and is conventionally secured, by structure not shown. Two tie plates are used at the top of each railroad tie, so located to accommodate two railroad ties having the proper gauge for the railroad track in question.

Reference is now made to FIG. 4, which illustrates fastener 20 in its full assembled position through a stepped aperture 50 preformed in a wooden railroad tie 44.

Figure 5:
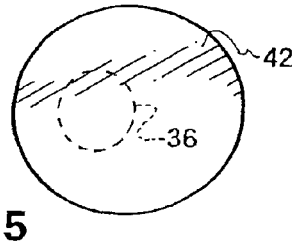
FIG. 5 is a bottom plan view taken along line 5-5 of FIG. 4.

The aperture 50 is representative of the other four apertures associated with each tie plate and comprises a top uniform diameter portion 52, the diameter of which is just slightly greater than the diameter of the shank 28 of fastener member 22. The aperture 50 is enlarged at shoulder or step 54 to accommodate snug reception of the boss 36 of the fastener member 24. The aperture 50 is again enlarged eccentrically at shoulder 56 to provide a disc-shaped recess to accommodating anti-rotation reception of the base 42 of the fastener member 24. This relationship is illustrated in FIG. 5. Thus, when fastener 22 is rotated so that external threads 26 into or out of the internal threads 38, the eccentricity of the base 42 in respect to the boss 36 prevents fastener 24 from rotating.

When the tie 44 comprises two or more layers 51 without bonding agent at interface 49, the tightened two-part fasteners compressive hold the layers together and prevent misalignment of layers.

The bottom surface of the base 42, in FIG. 4, is illustrated as being sealed by a layer or coating of protective material 60, which prevents corrosion and deterioration of the base 42 by reason of the tie 44 resting upon ballast, which comprises part of a railroad track.

FIG. 4 also illustrates the placement of a railroad rail, as part of a two rail track, on tie plate surface 48, held there by conventional structure, not shown.

Figure 6:
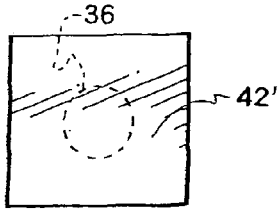
FIG. 6 is a bottom plan view taken along line 6-6 of FIG. 7.

Reference is now made to FIG. 7 which illustrates a railroad tie 44' formed of synthetic resinous or composite material. The aperture 50 shown in FIG. 7 is identical to aperture 50 shown in FIG. 4, with one exception. In lieu of the eccentric enlargement or recess 56, a concentric rectangular recess 56' is provided. This accommodates anti-rotate reception of the rectangular or square base 42' (FIGS. 2 and 6) in recess 56', thereby preventing rotation of fastener member 24' as the thread 26 of fastener member 22 are turned into or out of threads 38. While tie 44' may be of dense material, the present invention may be utilized with tie materials which are softer than dense hard wood, composite and synthetic resinous materials.

Figure 8:
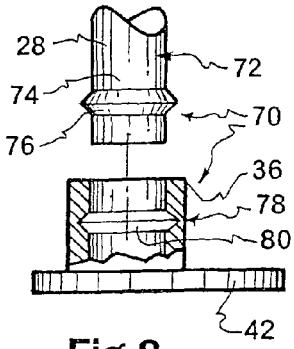
FIG. 8 is a fragmentary elevation shown partly in cross-section depicting a two-part fastener which may be used in lieu of the two-part fastener of FIG. 1 and which is adapted to create a force fit union within a tie aperture between the two fastener parts.

Reference is now made to FIG. 8 which illustrates an additional two-part fastener embodiment in accordance with the principles of the present invention. The two-part fastener of FIG. 8 is generally designated 70 and comprises an upper or male fastener, generally designated 72, which comprises a head (not shown), which may be identical to head 30 of FIG. 1, and an extended shaft 28. The distal end 74 is threadless but comprises a diametrally enlarged male connector 76, for purposes yet to be explained.

Two-part fastener assembly 70 also comprises a lower or female fastener member 78, shown as being identical to fastener member 24, FIG. 1, except threads 38 have been eliminated and a female annular grove 80 added in lieu thereof. The boss portion 36 also is without an outside indentation. The male annulus 76 and female groove 80 are sized and shaped such that when the top fastener 72 is driven, with a sledge hammer or like instrument, the annulus 76 forcibly passes through the hollow of the boss 36 and come to rest in the groove 80. Thus, the two fasteners 72 and 78 become locked to prevent inadvertent separation notwithstanding the vibration caused by railroad trains moving along the railroad track.

Figure 9:
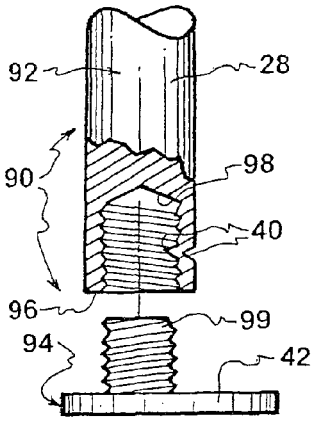
FIG. 9 is a fragmentary elevation, with a part broken away for clarity, illustrating an additional two-part fastener in accordance with principles of the present invention.

Reference is now made to FIG. 9, which illustrates a further two-part fastener embodiment in accordance with the principles of the present invention, generally designated 90. Fastener assembly 90 comprises a top fastener member, generally designated 92, and a bottom fastener member, generally designated 94. Fastener member 92 comprises a head (not shown) similar to previously described head 30 and a shank or shaft 28 running the full length of the fastener 92 without external threads. At the lower blunt edge 96 it is found a threaded blind bore 98, the diameter of which is reduced at location 40 to create an anti-rotate binding site.

Fastener 94 comprises previously described eccentric base 42, shown as being formed as one piece or integrated with a threaded upright stud 99 such that the axis of the stud 99 is eccentric to the axis of the base 42 to prevent rotation of the fastener member 94 while in a tie aperture when the threads at 98 are turned into or out of the threads of bore 98. The engagement of detent 40 with the threads of stud 98 prevents inadvertent separation of fastener members 92 and 94 because fastener member 92 is constrained at 40 against rotation.

Figure 10:
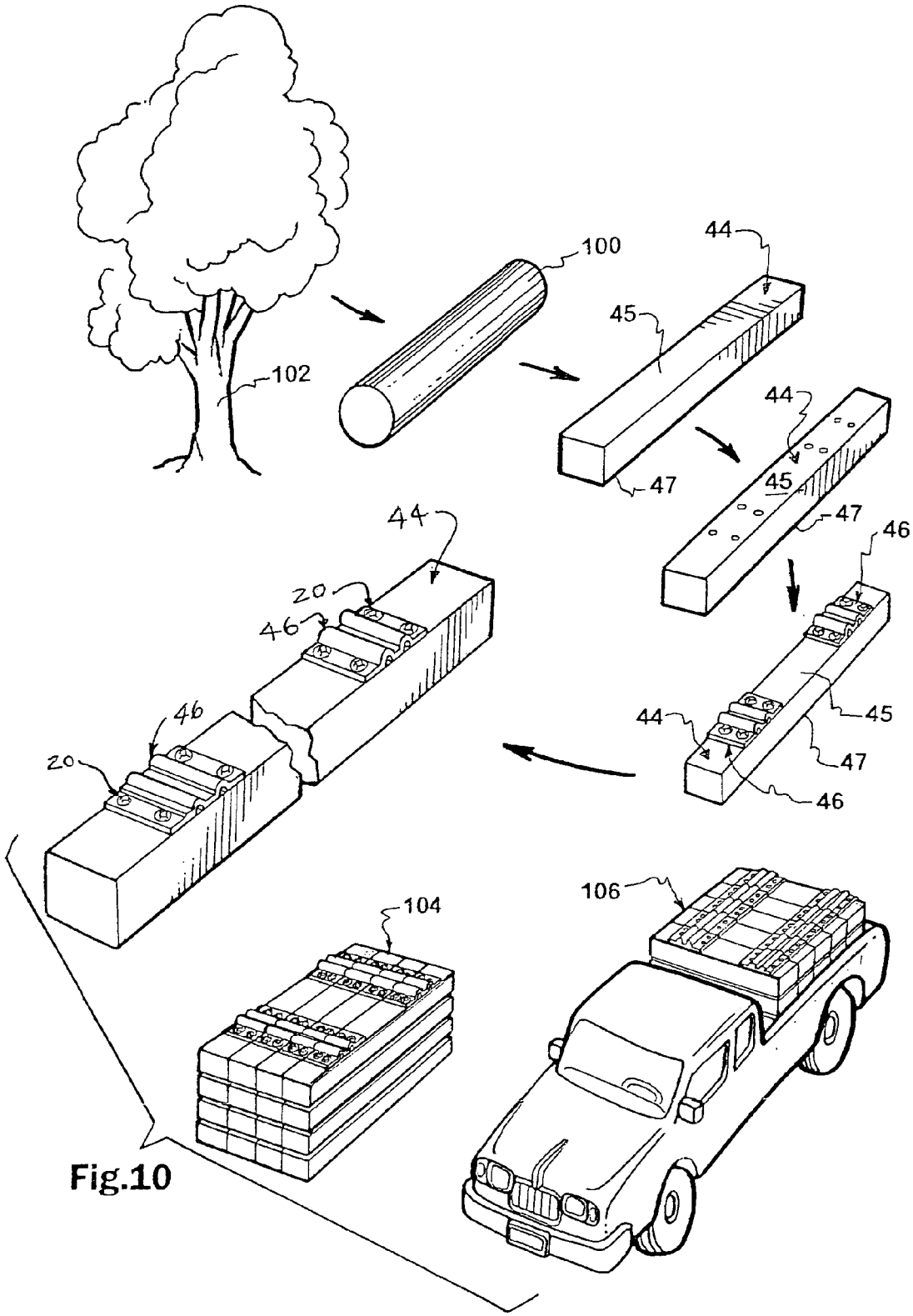
FIG. 10 is a diagrammatic representation of the manner in which railroad ties may be pre-plated and stored or transported, in accordance with principles of the present invention.

Reference is now made to FIG. 10, which illustrates, in diagrammatic form, one way in which pre-plated ties may be manufactured and stored in inventory or transported on vehicles for use. FIG. 10 is particularly significant in regard to the utilization of hard wood ties for which the present invention has particular application. In short, logs 100 are cut from trees 102 and thereafter, using commercial techniques, ties 44 are cut to size from logs 100. Ties 44 are pre-formed with a patterned array of apertures 50 located so as to become aligned with apertures into tie plates 46 placed on the top surface 45 of each tie 44.

A top fastener member of any of the types described above is placed, from the top, through each tie plate apertures 47 so as to extend into the associated tie aperture. A lower fastener member of the invention is placed from the bottom non-rotatably in the lower part of the associated tie aperture. The upper fastener member is connected against inadvertent separation to the lower fastener member, the connection being within the associated tie apertures 50, as explained above to create spikeless pre-plated ties, which may be stacked in inventory, as indicated at site 104, or placed on a vehicle and transported elsewhere for inventory or use purposes, as illustrated at site 106 in FIG. 10.

Figure 11:
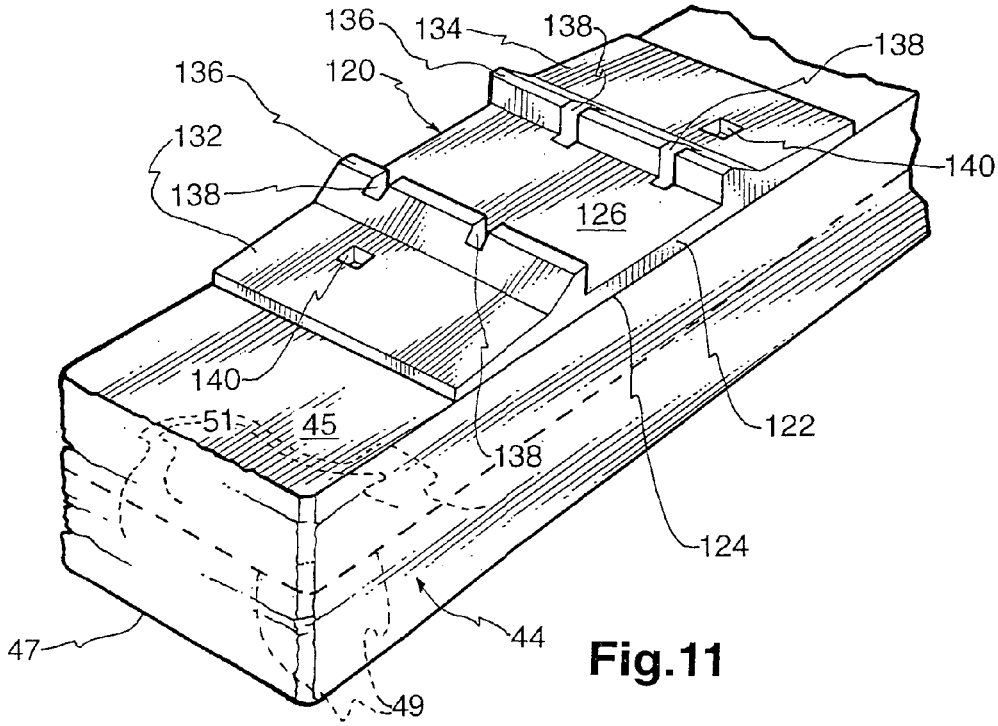
FIG. 11 is a fragmentary perspective of a tie plate, having six apertures, placed at a proper site on the top of a railroad tie, which may be monolithic or comprised of layers.
Figure 12:
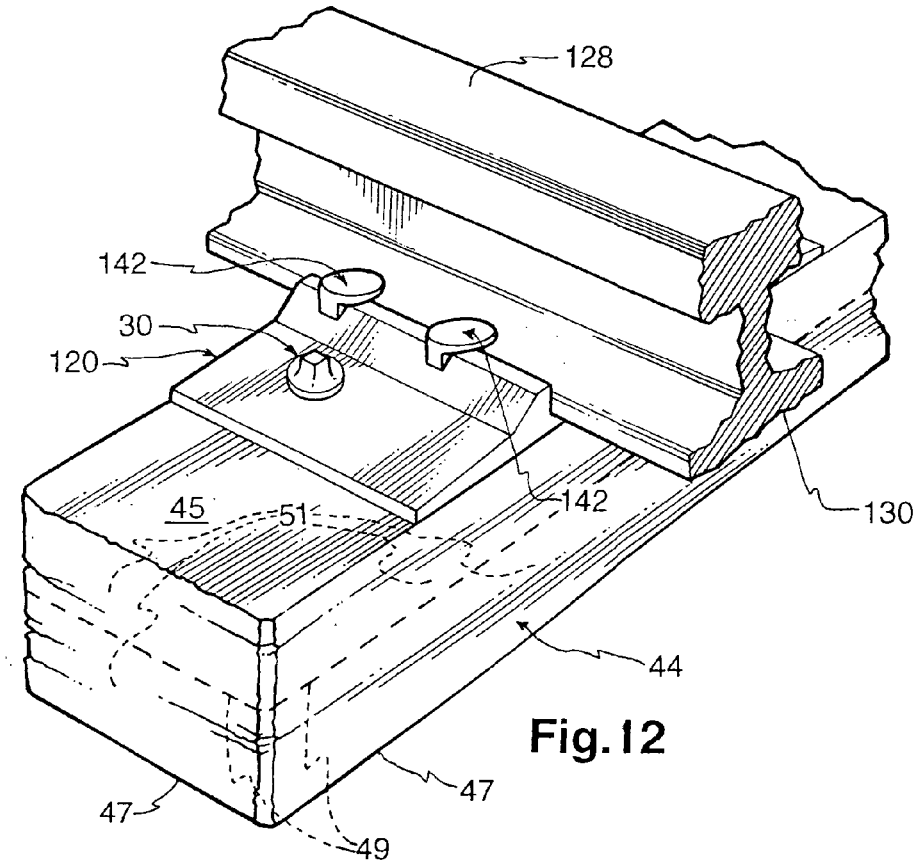
FIG. 12 is a fragmentary perspective of the tie plate of FIG. 11 secured to the tie by two recessed, two-part fasteners, with a rail shown secured to the tie plate by four railroad spikes.

Different types of tie plates are used on various railroads. Tie plate 46, described above, consists of a tie plate which does not utilize spikes to hold a railroad rail in position. Other forms of tie plates do use spikes to hold railroad rails in position. One such tie plate, generally designated 120, is illustrated in FIGS. 11 and 12 to which reference is now made. Two tie plates are used with each tie 44, only one of which is illustrated in FIGS. 11 and 12 to which reference is now made. Two tie plates are used with each tie 44, which may be one-piece or layered, only one of which is illustrated in FIGS. 11 and 12. Tie plate 120 comprises a base 122, the bottom surface 124 of which rests contiguously upon the top surface 45 of the tie 44. Base layer 122 is illustrated as having a width equal to the width of the tie 44. Base layer 122 is thicker at central portion 126, upon which a railroad rail 128 (FIG. 12) is placed so that the bottom surface 130 of the rail is contiguous with the central tie plate portion 126.

Each plate 120 also comprises an outside taper portion 132 and an inside taper portion 134. The tie plate 120 also comprises a pair of upright short flanges 136, which define the rail-receiving central portion 126. Each upright flange 136 is interrupted by two square vertically-directed apertures 138. A further square aperture 140 is centrally disposed in a vertical direction in each tapered end portion 132 and 134. Thus, each tie plate 120 comprises six apertures. The apertures 138 are adapted to each receive a railroad spike to retain rail 126 in position, as explained hereinafter in greater detail. Apertures 140 each receive two-part fasteners of the type explained above.

The tie 44 is pre-drilled at four locations, two for each tie plate 120, so as to create stepped vertically-directed apertures of the type described above at locations caused to be in alignment with apertures 140 when the tie plates 120 are correctly positioned on the top surface 45 of the tie 44. A two-part fastener 30 is caused to extend through each aperture 140 and each pre-drilled tie aperture 52 and thereafter tightened as shown and described in conjunction with FIGS. 4 and 7. FIG. 12 illustrates the two tightened two-part fasteners 30 by which the tie plate 120 is firmly and reliably joined to the tie 44. The rail 128 is initially positioned above and in contiguous relation with the central portion 126 of the tie 120 by force of gravity, followed by the driving of appropriately oriented spikes 142 through each aperture 138 and into the material comprising the tie 44 so as to securely and reliably hold the rail in its operable position. See FIG. 12.

Layered ties used with two-part fasteners of the present invention have significant advantages. They are environmentally friendly because use of discarded pre-used ties as a raw material does not mandate harvesting of new ties from living trees. Furthermore, this approach is cost-effective because the discarded ties are paid for. The layers, for multi-layer ties to be used with two-part fasteners of this invention, are simply conventionally cut from the discarded ties and the resulting layers are combined, bonded, if desired, drilled and caused to be connected together.

Reference is now made to FIGS. 13-22, which illustrate various ways that used, discarded railroad ties can be rehabilitated as composite railroad ties for further use in supporting railroad rails in a well known manner. Specific reference is made to FIG. 13, which illustrates a railroad tie, generally designated 110, comprising an upper tie component 112, shown as being formed of wood and fabricated from a used, discarded railroad tie in such a way as to remove a damaged portion from that tie, leaving component 112. Component 112 comprises a longitudinally extending male tongue 114, which is centrally disposed. The second component 116 of the composite railroad tie 110, formed from a second used, discarded tie so as to define a longitudinally extending, centrally disposed groove 118, sized, shaped and located to snugly receive the tongue 114 so that the surfaces of the components 112 and 116 directly adjacent to the tongue 114 and groove 118 become contiguous or nearly so when the tongue 114 is snugly placed into the groove 118. The two components 112 and 116 can be secured together in any suitable way, for example, by applying a satisfactory bonding agent to the interface surfaces 49 and the surfaces of tongue 114 and groove 118 so that the components 112 and 116 are integrated and function in unison as a tie when the bonding agent has cured and the tie is installed to support railroad rails.

Figure 13:
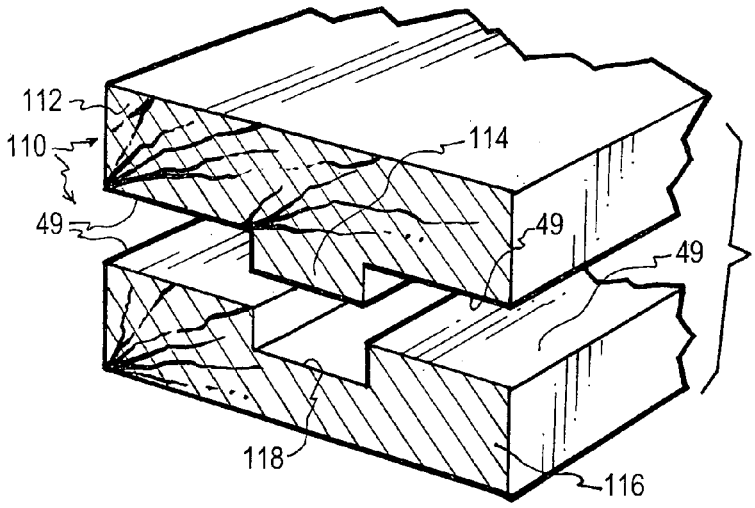
FIGS. 13-22 illustrate male/female connections by which damaged railroad ties are rehabilitated into composite ties.
Figure 14:
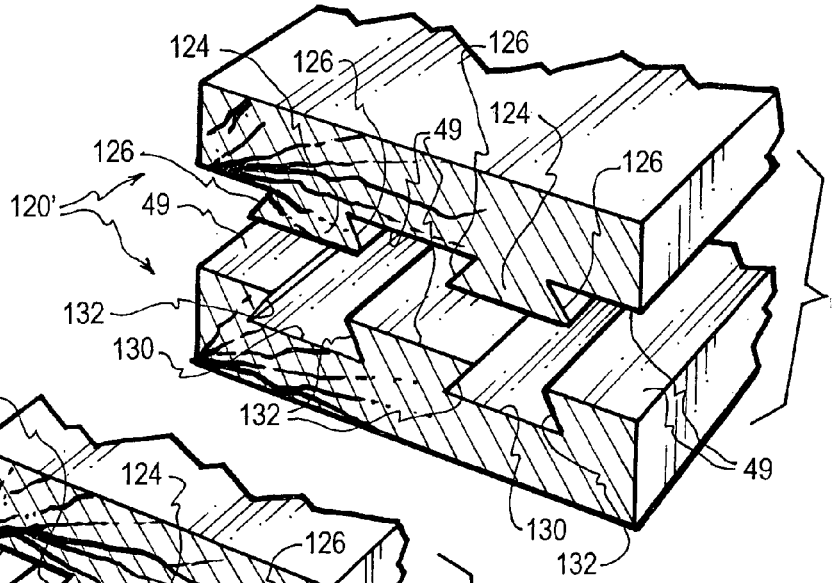
Figure 15:
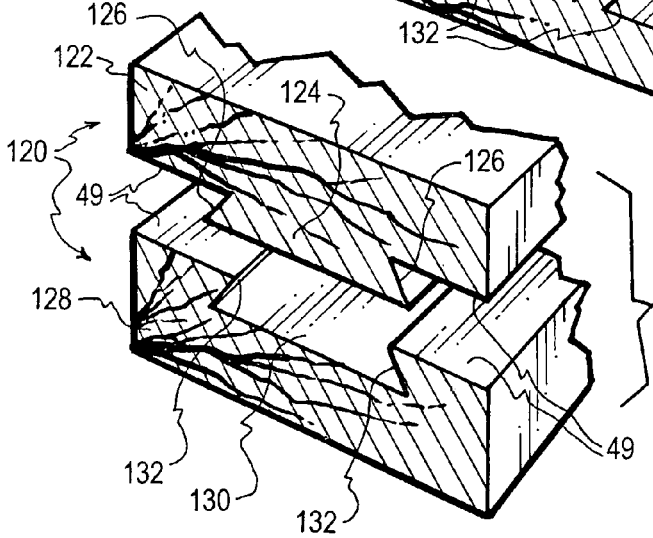

In lieu of the rectangular tongue and groove configuration 114/118 of the composite railroad tie 110 of FIG. 13, a single or double dovetail configuration illustrated in FIGS. 15 and 14, respectively, may be used. In the single dovetail composite tie 120 shown in FIG. 15, one tie component 122 comprises a male interface portion 124 of uniform depth, but comprising inwardly tapered side surfaces 126. The other tie component 128 comprises a female groove 130, located, sized and shaped so as to receive the centrally located axially directed male segment 124. Groove 130 comprises side edges 132, which match surfaces 126. When the top component 122 is offset axially from bottom component 128 so that the male segment 124 is aligned with the female segment 130, and a suitable bonding agent has been placed along the interface surfaces 49 of the two components 122 and 128, relative axial displacement of the components 128 and 122 will cause the male segment 124 to be received into female dovetail groove 130. When fully inserted, the tie 120 is uniform and constitutes an integration of components 122 and 128. When the bonding agent at interface 49 has set and cured, the composite tie 120 is ready for use.

The composite tie 120' of FIG. 14 comprises two male/female dovetail connectors as opposed to one, as depicted in FIG. 15 and described above. The foregoing description of the dovetail embodiment of FIG. 15 applies to the composite tie 120' of FIG. 14, the elements of FIG. 14 being enumerated as are the corresponding elements in FIG. 15.

Figure 16:
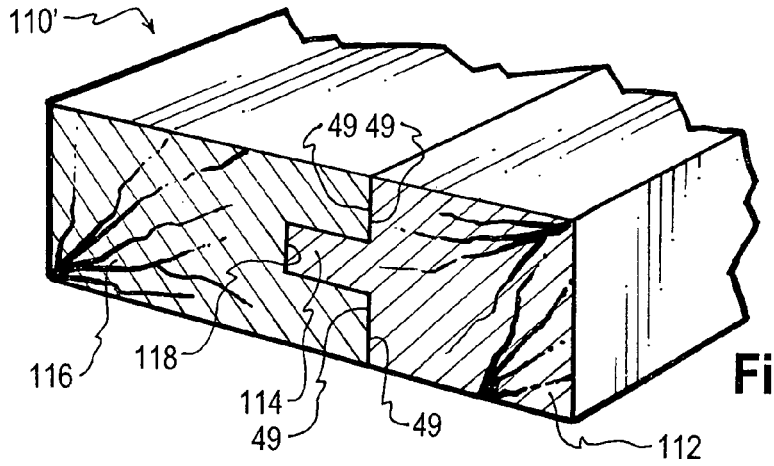

The composite railroad tie embodiment, generally designated 110' of FIG. 16, shows the completed tie, which is substantially identical and so enumerated as the composite tie 110 of FIG. 13, except the interface 49 is generally vertical as opposed to horizontal, as depicted in FIG. 13.

Used, discarded railroad ties often are damaged only at the top or bottom of one end. In such situations, the damaged area of the discarded railroad tie is removed by cutting the damaged portion from the remainder of the tie along intersecting vertical and horizontal cut lines to produce tie component 140 of FIG. 17 from the original discarded wooden tie. A second tie component is provided, having dimensions substantially identical to the portion of the original tie removed. This second component is illustrated as 142 in FIG. 17.

With or without other fasteners, a bonding agent may be placed at interface surfaces 49 of the two components 140 and 144 followed by the second component 142 being positioned within the vacant notched portion of the component 142 form a unified integrated tie, generally designated 144. One or more clamps may be used. The second component 142 may be of any suitable material including wood, a composite, graphite or synthetic resinous material. Again, while not shown in FIG. 17, fasteners with or in lieu of a bonding agent at interfaces 49 may be utilized including, but not limited to, recessed bolts, threaded screw fasteners and dowels.

Figure 17:
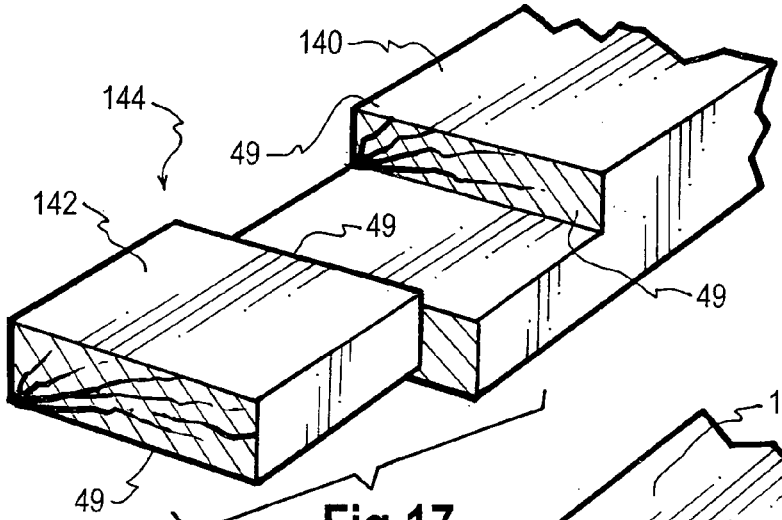
Figure 18:
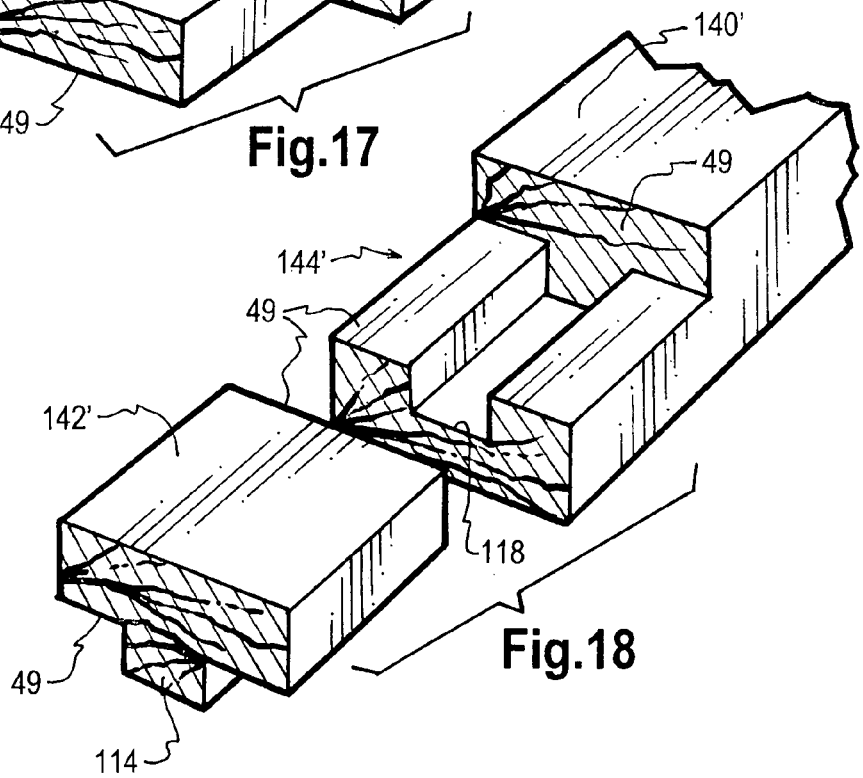

In lieu of or in addition to flat surfaces forming the interface between components 140 and 142 of FIG. 17, the added corner portion may include a male or female connector, a female or groove connector 118 being illustrated in FIG. 18. The groove 118 is illustrated as being rectangular in configuration, centrally disposed and axially directed. The tie component 142' includes a centrally located, axially directed male or tongue connector 114, designed to be located, sized and shaped to fit snugly in female cavity 118 so that with or without a bonding agent placed on interface surfaces 49 when the surfaces 49 are brought together, male connector 114 is snugly positioned in female connector 118, the combination results in composite railroad tie 144'.

Figure 20:
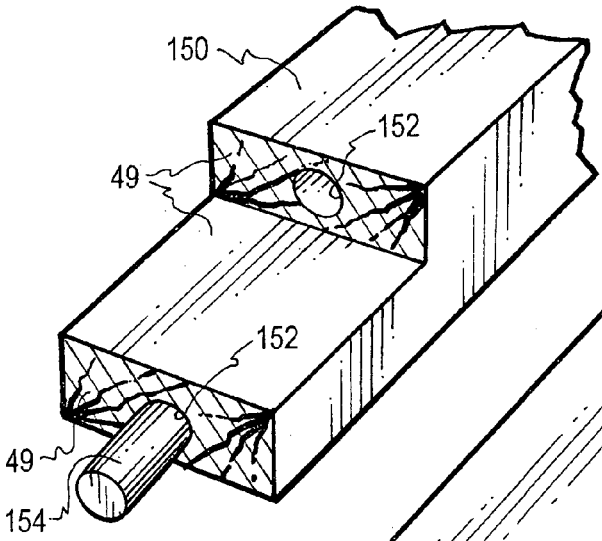
Figure 21:
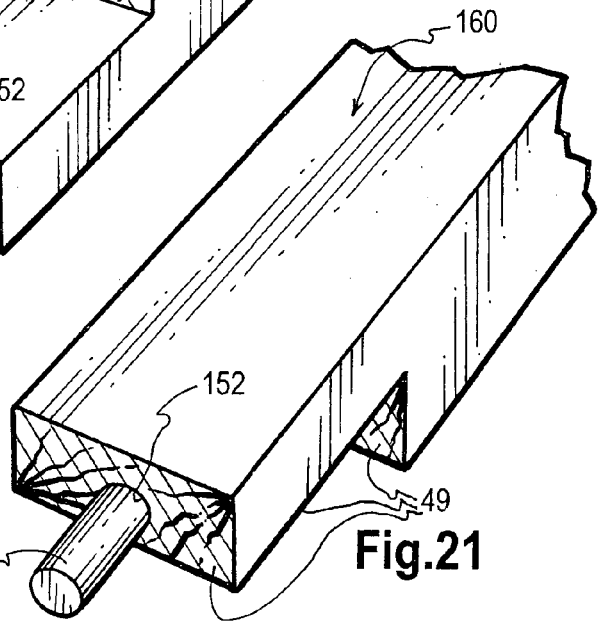
Figure 19:
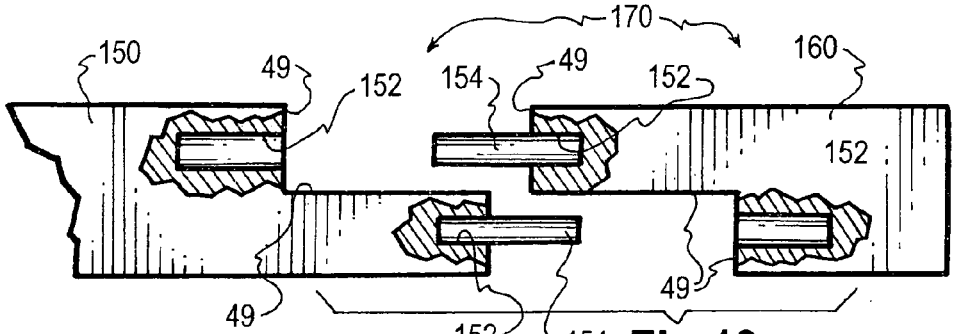

Similarly, where a used, discarded railroad tie has damage at one end extending from the top to the bottom, that damaged portion may be removed so that the end of the damaged tie becomes configurated as illustrated by tie component 150, illustrated in FIGS. 19 and 20. Tie component 150 comprises three interface surfaces 49, which are stepped at 90°, as best illustrated in FIG. 20. The top vertically directed shoulder surface 49 comprises a centrally located, axially directed blind bore 152 and the second vertically directed interface shoulder surface 49 comprises a centrally located, axially directed blind bore 152 into which a correspondingly sized dowel 154 has been inserted and secured, as by a press fit connection or use of a bonding agent.

A second stepped tie component 160 (FIG. 21) is provided and combined with component 150 to form a composite tie, generally designated 170. FIG. 19. Second stepped tie component 160 comprises a top vertical interface surface 49 interposed between vertical surfaces 49. Top vertical interface surface 49 of tie component 160 comprises a centrally located, axially directed blind bore 152 into which another dowel 154 is securely inserted and retained as by press fit or use of a bonding agent. Tie component 160 comprises a horizontally directed intermediate interface surface 49 having the same dimensions as the horizontal interface surface 49 of component 150. The tie component 160 also comprises a lower vertically directed interface surface 49 centrally and axially interrupted by an additional blind bore 152. The component 160 is sized, shaped and ultimately located so as to replace and replicate the damaged portion removed from the originally used, discarded tie. When the interface surfaces 49 and the open blind bores 152 of the two tie components are appropriately coated with a bonding agent and the two components 150 and 160 are positioned as illustrated in FIG. 19, relative axially movement of the two components 150 and 160 will cause the top dowel 154 to be retainingly received by the top blind bore 152 and the bottom dowel 154 to be retainingly received in the bottom blind bore 152, with all of the directly adjacent interface surfaces 49 being essentially contiguous with each other, except for the bonding agent when used. The result is an assembled, integrated and unitary composite tie 170, which, upon setting and curing of the bonding agent is ready for use in the support of two railroad rails in the well known manner.

It should be readily apparent that the materials used to form tie components 142, 142' and 160 may be of any suitable material such as wood, graphite, composites and synthetic resinous materials.

Figure 22:
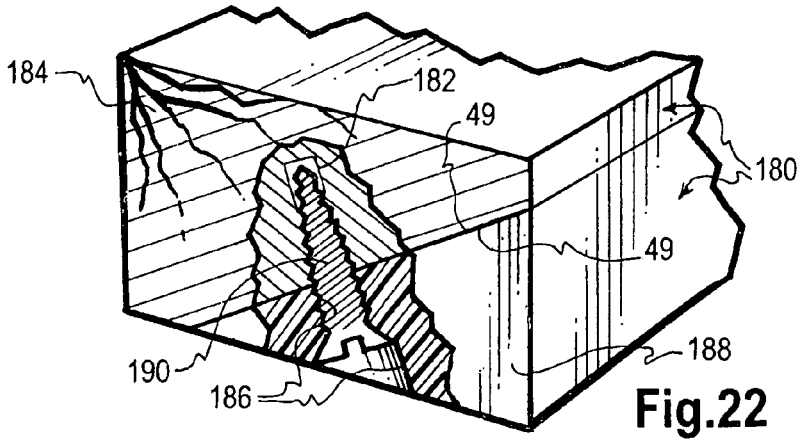

Reference is now made to FIG. 22 which illustrates a further embodiment in accordance with the present invention. Sometimes a discarded, used and damaged railroad tie desired to be rehabilitated will be damaged only at one end along one corner, in which case a composite tie, generally designated 180, may be formed as illustrated in FIG. 22. From the discarded wooden tie, the damaged corner is removed, typically by utilization of a power saw to create a diagonal interface 49. A series of spaced blind bores 182 are drilled perpendicular or otherwise through the interface 49 into the body of the remaining tie component 184. A second tie component 186 is provided, identical to the portion of the original tie removed. Tie component 186 may be of any suitable material, a synthetic resinous material being illustrated in FIG. 22. The tie component 186 comprises a plurality of throughbores 186 spaced so as to be aligned with blind bores 182. The second tie component 186 comprises a diagonal interface surface 49. When the two surfaces 49 are caused to be contiguous so as to collectively form a rectangular composite tie 180, a threaded fastener 190 is turned or rotated into each set of aligned bores 186 and 182 to secure the tie components 184 and 188 together as illustrated in FIG. 22.

The invention may be embodied in other specific forms without departing from the spirit of the essential characteristics thereof. The present embodiments, therefore, are to be considered in all respects as illustrative and are not restrictive, the scope of the invention being indicated by the appended claims rather than by the foregoing description, and all changes which come within the meaning and range of equivalency of the claims are therefore intended to be embraced therein.

What is claimed and described to be secured by Letters Patent is:

1. A composite reclaimed railroad tie, having a length in a longitudinal direction, comprising:

at least two tie components and at least one interlocking connection comprising a male part and a female part;

the first wooden tie component comprising a used, discarded wooden railroad tie with at least one damaged portion thereof removed to create one of the two interlocking parts extending in a longitudinal direction;

the second wooden tie component dimensionally replicating the removed damaged portion and further comprising the second interlocking part extending in a longitudinal direction and snugly fully united with and matching the one part of the first tie component;

the interlocking connection being defined by three pairs of adjacent surfaces, two of the pairs surfaces being oppositely sloped to prevent separation of the tie components at the connection.

2. A reclaimed railroad tie according to claim 1, wherein each surface of the three pairs of surfaces is planar and each sloped pair comprises two essentially parallel planar surfaces.

3. A method of making a railroad tie having a longitudinal length formed from at least two tie components, at least one of which comprising a previously used and discarded wooden railroad tie comprising:

providing at least two wooden railroad tie components, at least one of which comprises a previously used discarded wooden railroad tie reduced in size by removing at least one defective portion;

fashioning at least one longitudinally-directed dovetail-shaped female connector slot in one tie component;

fashioning at least one longitudinally-directed dovetail-shaped male connector in the other tie component sized and located to snugly interfit into the female connector slot;

relatively displacing in a longitudinal direction the male dovetail-shaped male connector and the female dove-shaped connector fully into essentially contiguous relation.

4. A railroad tie having a longitudinal length formed from at least first and second tie components, at least one of which comprises a previously used and discarded wooden railroad tie comprising:

at least first and second wooden railroad tie components, at least one of which comprises a previously used discarded wooden railroad tie reduced in size by removing defective portions;

a longitudinally-directed dovetail-shaped female connector slot, formed in one tie component;

a longitudinally directed dovetail-shaped male connector integrally formed on the other tie component sized and located to snugly interfit into the female connector slot, the two dovetail-shaped connectors being fully relatively displaced in a longitudinal direction into essentially contiguous relation.

5. A railroad tie having a longitudinal length formed from at least two tie components one of which comprises a previously used and discarded wooden railroad tie comprising:

at least two integrated wooden railroad tie components, at least one of which comprises a previously used discarded wooden railroad tie reduced in size by removing cracked and otherwise defective portions;

the two wooden railroad tie components being connected together by at least one interlocking connection comprising mating and interlocking male and female connector parts.

* * * * *